US009031264B2

(12) United States Patent
Yang

(10) Patent No.: US 9,031,264 B2
(45) Date of Patent: May 12, 2015

(54) RADIATION-RESISTANT EARPHONE WIRE

(71) Applicant: Samya Technology Co., Ltd., Taoyuan County (TW)

(72) Inventor: Fu-I Yang, Taoyuan County (TW)

(73) Assignee: Samya Technology Co., Ltd., Taoyuan County (TW)

( * ) Notice: Subject to any disclaimer, the term of this patent is extended or adjusted under 35 U.S.C. 154(b) by 432 days.

(21) Appl. No.: 13/650,409

(22) Filed: Oct. 12, 2012

(65) Prior Publication Data

US 2014/0105430 A1 Apr. 17, 2014

(51) Int. Cl.

| | |
|---|---|
| ***H04R 25/00*** | (2006.01) |
| ***H04R 1/10*** | (2006.01) |
| *H01F 17/06* | (2006.01) |

(52) U.S. Cl.

CPC ..... *H04R 1/1033* (2013.01); *H01F 2017/065* (2013.01)

(58) Field of Classification Search

CPC .... H04R 1/1033; H04R 33/7664; H04R 1/10; H04F 2017/065; H05K 1/0216; H05K 1/0218; H04B 1/3838

USPC ..... 381/384, 189, 370; 361/816, 818; 379/430

See application file for complete search history.

(56) References Cited

U.S. PATENT DOCUMENTS

| | | | | |
|---|---|---|---|---|
| 5,335,366 | A * | 8/1994 | Daniels | 455/575.5 |
| 6,095,820 | A * | 8/2000 | Luxon et al. | 343/702 |
| 6,249,256 | B1 * | 6/2001 | Luxon et al. | 343/702 |
| 2010/0151922 | A1 * | 6/2010 | Zheng | 455/575.1 |
| 2012/0114162 | A1 * | 5/2012 | Zheng | 381/384 |

* cited by examiner

*Primary Examiner* — Tuan D Nguyen
(74) *Attorney, Agent, or Firm* — Rosenberg, Klein & Lee

(57) ABSTRACT

The invention relates to a radiation-resistant earphone wire, particularly to signal lines having at least a radiation-resistant device on a predetermined position thereof and the radiation-resistant device including: a radiation absorber being a cylindrical body, made of a magnetic material with high permeability and having a first through hole in a middle thereof and a radiation blocker made of a metal sleeve body and coating on an outer periphery of the radiation absorber and a top of the radiation blocker corresponding to the first through hole has a second through hole for the signal lines passing through. Based on the features disclosed, the radiation absorber at an inner layer absorbs EMI radiation and the radiation blocker at an outer layer has a shielding effect and both the radiation absorber and the radiation blocker together form an anti-EMI structure, avoiding human brain damage caused by the electromagnetic waves.

4 Claims, 4 Drawing Sheets

RADIATION-RESISTANT EARPHONE WIRE

BACKGROUND OF THE INVENTION

1. Field of the Invention

The invention relates to an earphone wire, particularly to a radiation-resistant device arranged on signal lines.

2. Description of the Related Art

Respecting the popularity of mobile communication devices, a large number of the wireless transmission products are produced for fulfilling people's needs so various radiation waves are invisibly full of human living environment, resulting in the potential impact on human health. In particular, the mobile phone is the essential item in the modern life. When being close to the ear to talk on the mobile phone, the electromagnetic waves make great impact on the human brain. Therefore, to avoid the human brain damage caused by the electromagnetic waves, human can use not only the hands-free mobile phones but the earphone wire.

With the reference to FIG. 1, a conventional earphone wire 30 comprises a sound-source connecting plug 31, signal lines 32 and a speaker 33. The earphone wire 30 allows the sound-source connecting plug 31 to pick up the signals from an inner layer of a mobile phone such that the radiation may be conducted by the sound-source connecting plug 31. In addition, the speaker 33 is placed directly in the ear so that the radiation from the mobile phone may cause damage to human health for a long term use.

SUMMARY OF THE INVENTION

It is a primary object of the present invention to provide a radiation-resistant earphone wire to substantially reduce the electromagnetic interference for getting better audio signal and to avoid human brain damage caused by the electromagnetic waves.

In order to achieve the above object, a radiation-resistant earphone wire, comprising: signal lines including a left audio channel and a right audio channel and having an end thereof connected to a sound-source connecting plug and the other end thereof respectively connected to a speaker, wherein the signal lines has at least a radiation-resistant device on a predetermined position thereof and the radiation-resistant device including: a radiation absorber being a cylindrical body, made of a magnetic material with high permeability and having a first through hole in a middle thereof; and a radiation blocker made of a metal sleeve body and coating on an outer periphery of the radiation absorber and a top of the radiation blocker corresponding to the first through hole has a second through hole for the signal lines passing through; whereby the radiation absorber at an inner layer absorbs EMI radiation and the radiation blocker at an outer layer has a shielding effect and both the radiation absorber and the radiation blocker together form an anti-EMI structure.

The present invention further comprises a tight sleeve arranged at a bottom of the radiation absorber and having a third through hole for the signal lines passing through and the signal lines are tighten and positioned by the third through hole. Moreover, the tight sleeve can be molded with the signal lines for positioning.

Based on the features disclosed, the present invention prevents the body damage from the radiation wave and solves the problems of the conventional earphone wire.

DETAILED DESCRIPTION OF THE PREFERRED EMBODIMENT

Figure 1:
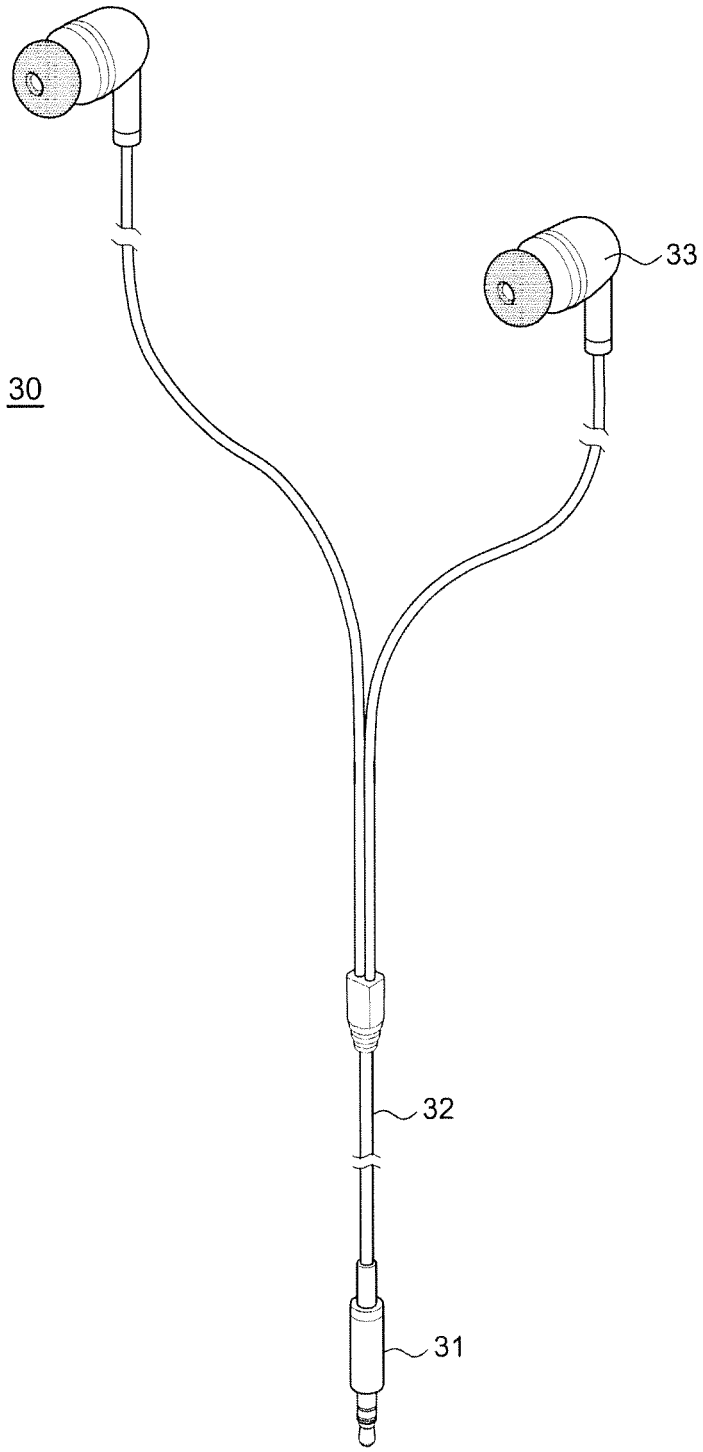
FIG.1 PRIOR ART
FIG. 1 is a schematic view of a conventional earphone wire.
Figure 2:
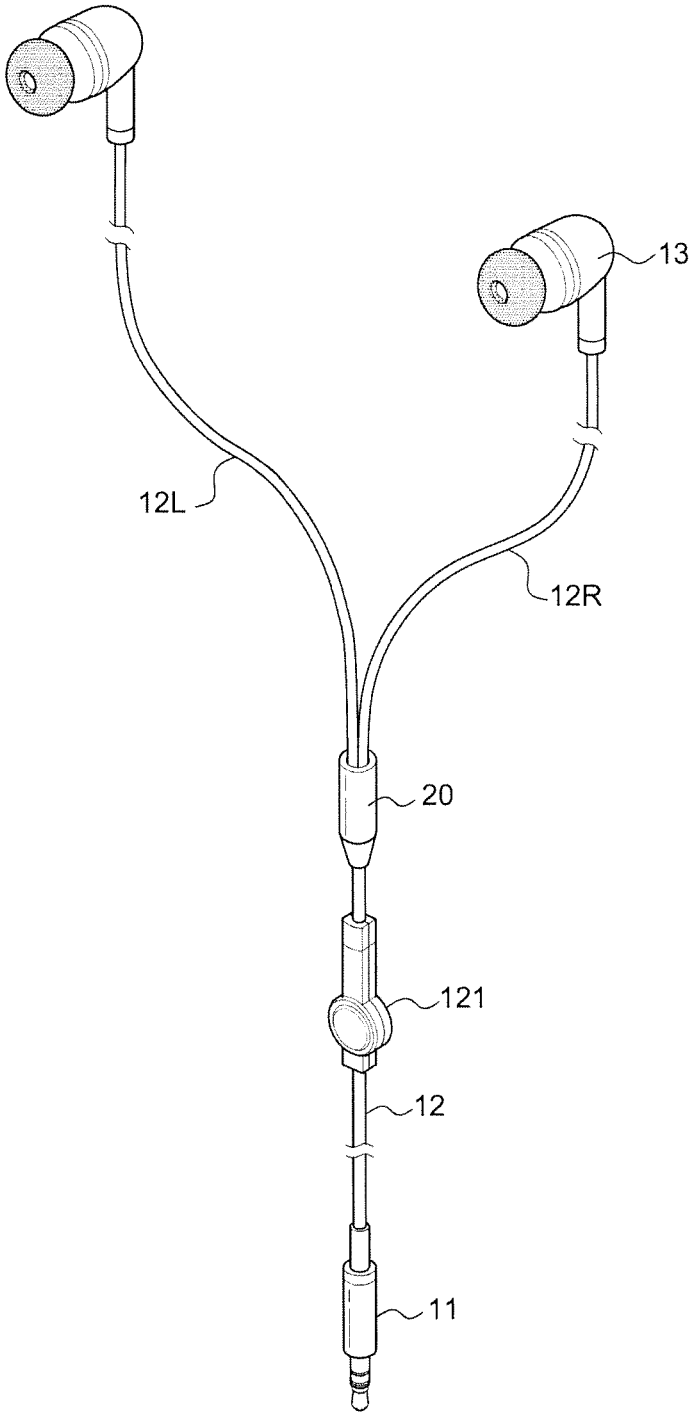
FIG. 2 is an external perspective view of the present invention.
Figure 3:
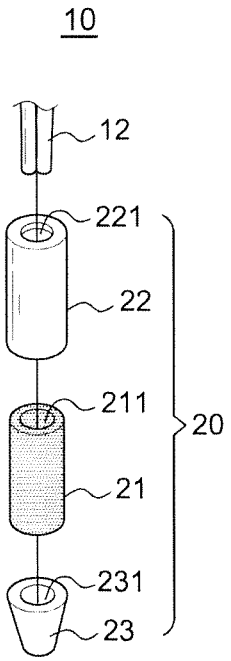
FIG. 3 is an exploded perspective view of the radiation-resistant device in accordance with the present invention.
Figure 4:
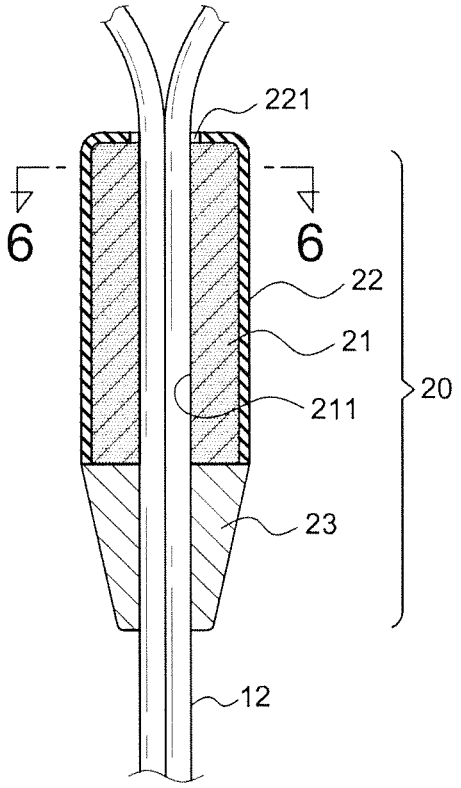
FIG. 4 is a sectional view of the radiation-resistant device in accordance with the present invention.
Figure 5:
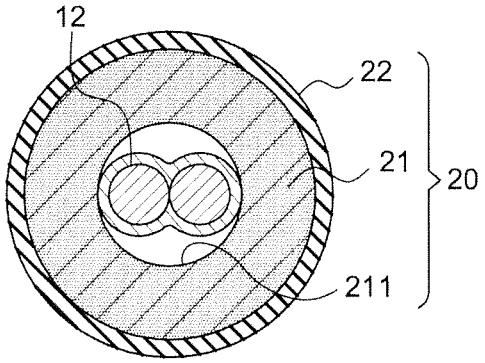
FIG. 5 is a cross-sectional view taken along the line 6-6 in FIG. 5.

Referring to FIGS. 2 through 7, the preferred embodiment of a radiation-resistant earphone wire 10 in accordance with the present invention comprises: signal lines 12 having an end thereof connected to a sound-source connecting plug 11 and the other end thereof respectively connected to a speaker 13. The signal lines 12 are separated into two independent channels, a left audio channel 12L and a right audio channel 12R from a connector 121 at a middle section thereof. However, the earphone wire is a prior art and thus will not be described in details here.

The present invention comprises at least a radiation-resistant device 20 on a predetermined position of the signal lines 12, including: a radiation absorber 21 being a cylindrical body, made of magnetic material with high permeability and having a first through hole 211 in a middle thereof, and a radiation blocker 22 made of a metal sleeve body and coating on an outer periphery of the radiation absorber 21. Moreover, a top of the radiation blocker 22 corresponding to the first through hole 211 has a second through hole 221 for the signal lines 12 passing through. Whereby the radiation absorber 21 at an inner layer absorbs EMI radiation and the radiation blocker 22 at an outer layer has a shielding effect. Both the radiation absorber 21 and the radiation blocker 22 together form an anti-EMI structure.

In this embodiment, the present invention further comprises a tight sleeve 23 at a bottom of the radiation absorber 21 has a third through hole 231 for the signal lines 12 passing through and the signal lines 12 are tighten and positioned by the third through hole 231. Moreover, the tight sleeve 23 can be molded with the signal lines 12 for positioning.

In this embodiment, the magnetic material may include composite material of $Fe_2O_3$, $Fe_3O_4$, $Fe_3C$ or $Fe_7C_3$.

Based on the features disclosed, the present invention has following effects:

1. Each element of the radiation-resistant device 20 is independently molded before being assembled to the signal lines 12. This kind of setting is very convenient.

2. More importantly, the radiation-resistant device 20 is composed of the radiation absorber 21 at the inner layer and the radiation blocker 22 at the outer layer forming the radiation-resistant structure. The present invention provides the high permeability magnetic material as a shielding material to absorb radiation for the basis shielding effect. However, during the test, the magnetic material has less influence on the radiation if the magnetic material does not be coated. Therefore, the prevent invention further provides the radiation blocker 22 made of metal material to increase the shielding effect and reduce impact of electromagnetic waves on the human body.

Figure 6:
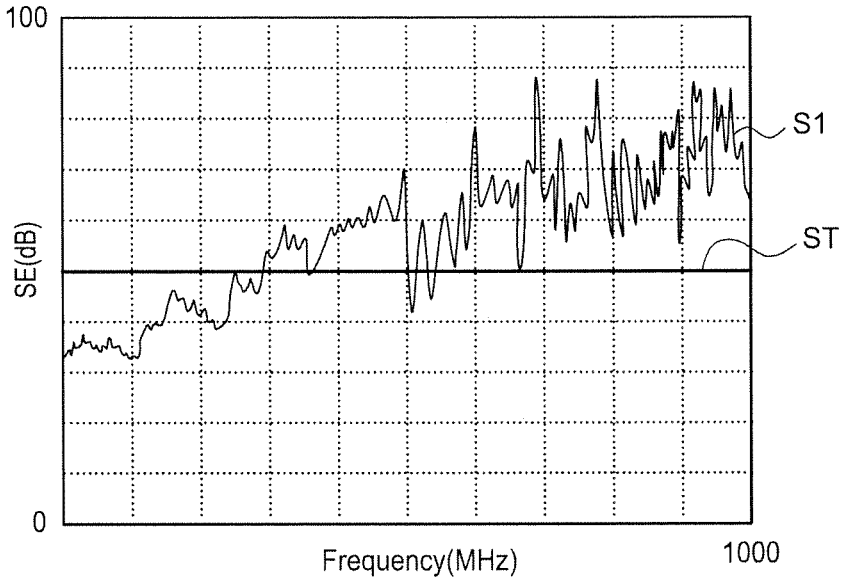
FIG. 6 is a schematic view of EMI signal waveform of the present invention, showing the earphone wire without the radiation-resistant device; and, FIG. 7 is a schematic view of EMI signal waveform of the present invention, showing the earphone wire with the radiation-resistant device.
Figure 7:
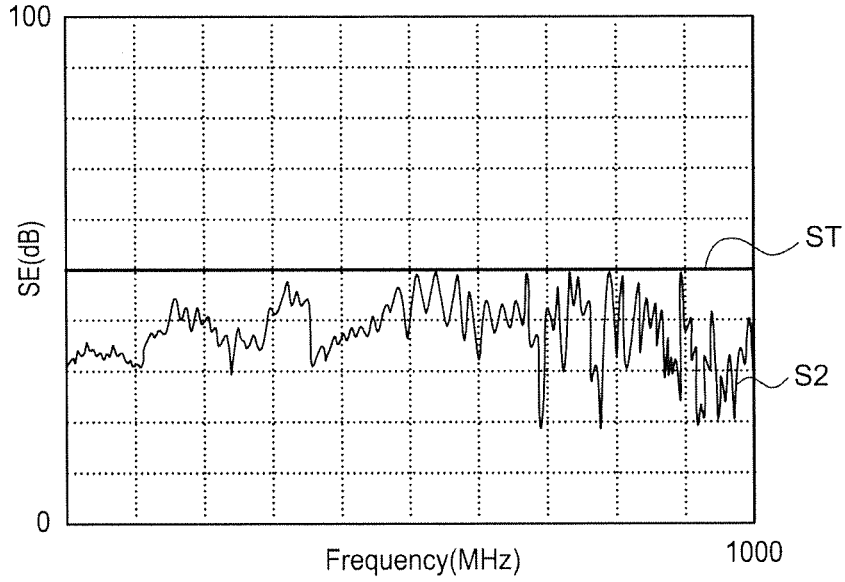

3. The radiation-resistant device 20 is able to intercept and eliminate radiation on the way of signal transmission. FIG. 6 is a schematic view of EMI signal waveform, showing the earphone wire without the radiation-resistant device 20. As shown in FIG. 6, the EMI signal S1 is out of the safety standard ST. FIG. 7 is a schematic view of EMI signal waveform of the present invention, showing the earphone wire with the radiation-resistant device 20. As shown in FIG. 7, the EMI signal S1 is under the safety standard ST.

Therefore, the present invention prevent provides the radiation-resistant device 20 to substantially prevent brain cells damage from the radiation wave and solve the problems of the conventional headphone wire.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A radiation-resistant earphone wire, comprising:

signal lines including a left audio channel and a right audio channel and having an end thereof connected to a sound-source connecting plug and the other end thereof respectively connected to a speaker, wherein the signal lines has at least a radiation-resistant device on a predetermined position thereof and the radiation-resistant device including:

a radiation absorber being a cylindrical body, made of a magnetic material with high permeability and having a first through hole in a middle thereof; and a radiation blocker made of a metal sleeve body and coating on an outer periphery of the radiation absorber and a top of the radiation blocker corresponding to the first through hole has a second through hole for the signal lines passing through;

whereby the radiation absorber at an inner layer absorbs EMI radiation and the radiation blocker at an outer layer has a shielding effect and both the radiation absorber and the radiation blocker together form an anti-EMI structure.

2. The radiation-resistant earphone wire as claimed in claim 1, further comprising a tight sleeve arranged at a bottom of the radiation absorber has a third through hole for the signal lines passing through and the signal lines are tighten and positioned by the third through hole.

3. The radiation-resistant earphone wire as claimed in claim 2, wherein the tight sleeve can be molded with the signal lines for positioning.

4. The radiation-resistant earphone wire as claimed in claim 1, wherein the magnetic material includes composite material of $Fe_2O_3$, $Fe_3O_4$, $Fe_3C$ or $Fe_7C_3$.

* * * * *